US008292025B1

(12) United States Patent
Woodell et al.

(10) Patent No.: US 8,292,025 B1
(45) Date of Patent: Oct. 23, 2012

(54) FIREARM SOUND SUPPRESSOR

(76) Inventors: Phillip Lynn Woodell, Elgin, SC (US); Jenny Rebekah Woodell, Elgin, SC (US)

( * ) Notice: Subject to any disclaimer, the term of this patent is extended or adjusted under 35 U.S.C. 154(b) by 0 days.

(21) Appl. No.: 13/099,602

(22) Filed: May 3, 2011

(51) Int. Cl.
*F41A 21/00* (2006.01)

(52) U.S. Cl. ..... 181/223; 89/14.4

(58) Field of Classification Search ..... 181/223; 89/14.4

See application file for complete search history.

(56) References Cited

U.S. PATENT DOCUMENTS

| | | | | | |
|---|---|---|---|---|---|
| 658,934 | A * | 10/1900 | Washington | 181/223 |
| 1,021,742 | A | 3/1912 | Moore | |
| 1,342,978 | A * | 6/1920 | Young | 89/14.3 |
| 3,385,164 | A * | 5/1968 | Hubner et al. | 89/14.4 |
| 4,479,418 | A * | 10/1984 | Beretta | 89/14.4 |
| 4,588,043 | A | 5/1986 | Finn | |
| 5,136,923 | A | 8/1992 | Walsh, Jr. | |
| D415,812 | S | 10/1999 | Andrews, Jr. | |
| D415,813 | S | 10/1999 | O'Quinn | |
| D435,623 | S | 12/2000 | Andrews, Jr. | |
| 6,575,074 | B1 * | 6/2003 | Gaddini | 89/14.4 |
| 6,722,254 | B1 * | 4/2004 | Davies | 89/14.3 |
| 6,923,292 | B2 * | 8/2005 | Woods et al. | 181/223 |
| 7,412,917 | B2 | 8/2008 | Vais | |
| D594,082 | S * | 6/2009 | O'Quinn | D22/108 |
| 7,587,969 | B2 | 9/2009 | Silvers | |
| 7,600,606 | B2 | 10/2009 | Brittingham | |
| 7,856,914 | B2 * | 12/2010 | Shults et al. | 89/14.4 |
| 2007/0107590 | A1 | 5/2007 | Silvers | |
| 2011/0036233 | A1 * | 2/2011 | DeGroat | 89/14.4 |

* cited by examiner

*Primary Examiner* — Forrest M Phillips
(74) *Attorney, Agent, or Firm* — B. Craig Killough

(57) ABSTRACT

A sound suppressor for firearms is characterized by a baffle core having a blast chamber that is larger than a remaining plurality of chambers. The blast chamber is proximal to a mounting point of the sound suppressor to a firearm. The baffle core is contained in a body. An external structural frame is positioned externally over a portion of the body, and over the blast chamber.

12 Claims, 3 Drawing Sheets

FIREARM SOUND SUPPRESSOR

FIELD OF THE INVENTION

This invention relates to firearms generally and is more particularly directed to advices for suppressing noise, muzzle flash and recoil of host firearms.

BACKGROUND OF THE INVENTION

Firearm suppressor or "silencers" are attached to the distal end of barrels of firearms to suppress the noise associated with discharging a firearm. Reducing the noise as much as possible is a goal of firearm suppressors.

SUMMARY OF THE INVENTION

A firearm sound suppressor or "silencer" according to the present invention is characterized by a baffle core that is contained within a body. The baffle core has a series of chambers and a central void. The baffle core has a blast chamber that is proximal to a mounting point of the sound suppressor to the firearm. The blast chamber is enlarged relative to the remaining plurality of chambers. An external structural frame is mounted externally to the body. The enlarged blast chamber traps and cools gases that are discharged by a fired bullet. The external structural frame provides support for the suppressor relative to the blast chamber and allows for a larger and more efficacious blast chamber.

DETAILED DESCRIPTION OF PREFERRED EMBODIMENTS

Figure 1:
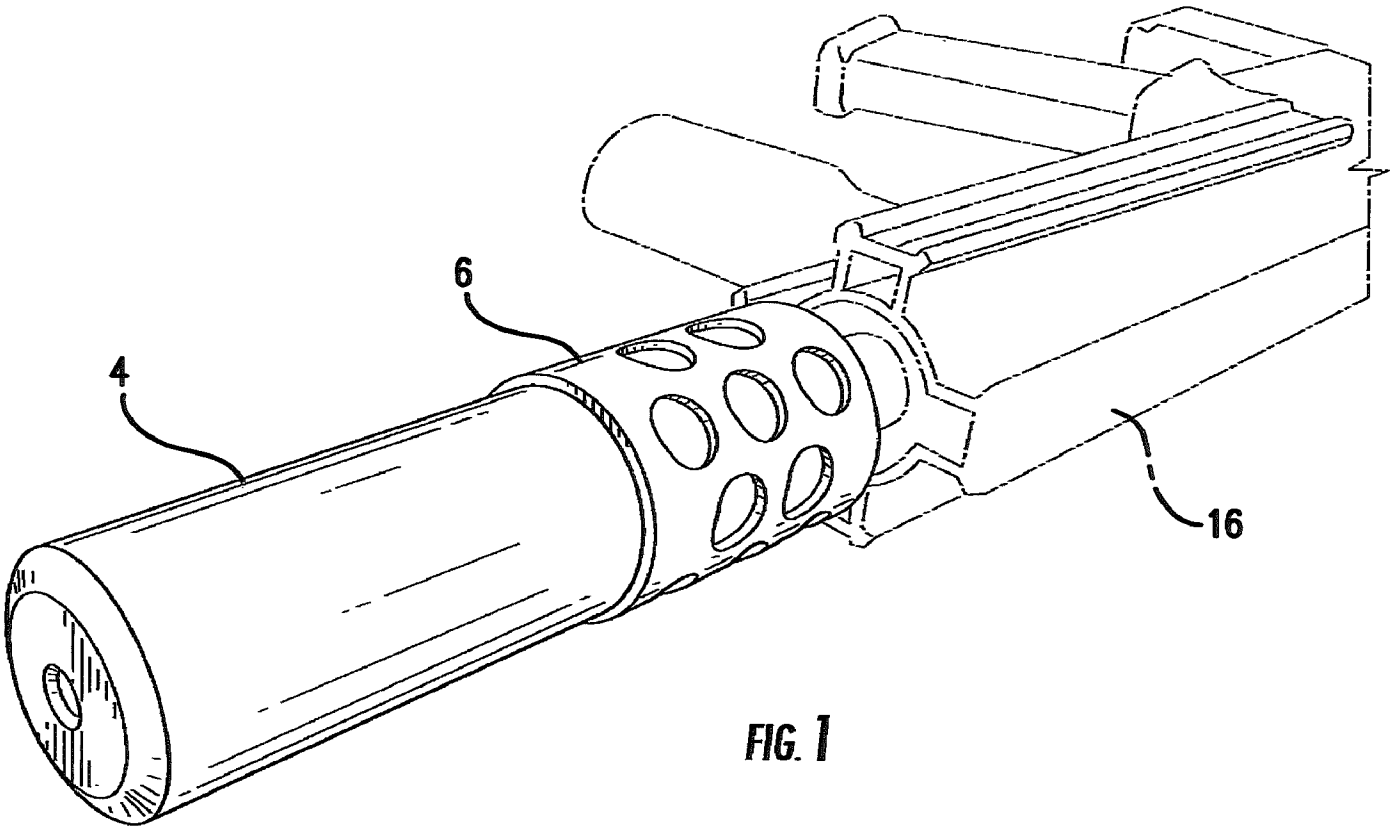
FIG. 1 is a perspective view of an embodiment of the suppressor mounted to a demonstrative firearm, shown as a phantom.

The suppressor of the present invention comprises a baffle core. The baffle core 2 is preferred to be formed in a unitary manner, from a single piece of material, such as forging the baffle core from a billet, or casting it. The material may be a metal alloy formed from into a single baffle core. The baffle core could be formed of other materials such as thermoplastics, ceramics or resins that are heat resistant. The baffle core comprises a central void 12 through which a discharged bullet passes, so that the bullet travels completely and longitudinally through the baffle core.

The baffle core is preferred to be contained in a body 4. The body may be a cylindrical tube. The body may be any appropriate shape for containing the corresponding baffle core according to the remaining requirements set forth herein. The body may be round, square, or triangular according to the shape of the baffle core. The body may be secured by crimping/rolling the body into a small groove at each end of the baffle core.

The baffle core of a preferred embodiment of the invention comprises a plurality of chambers 8. The chambers may be curved. The chambers may be "S" shaped chambers. The curved chambers, such as the S-shaped chambers, may be nested and overlap, as shown in this embodiment.

In the embodiment shown, the "S" shaped chambers are positioned distal to a mounting point 14 of the suppressor to a firearm 16. A blast chamber 10 is positioned distal to a mounting point of the suppressor to a firearm. The blast chamber is preferred to be materially larger than the rest of the plurality of chambers. The blast chamber must have a relatively large void to efficaciously allow expansion, trapping and cooling of gases produced by firing of the firearm. There should be no interference by structural elements of the suppressor with the blast chamber that would reduce the volume of the blast chamber.

In the embodiment shown in the drawings, the blast chamber 10 is an "L" shaped chamber. The blast chamber is proximal to the firearm, and is the first chamber that receives the bullet and associated gases from the barrel of the firearm. Accordingly, the gas pressures as received by the suppressor are the highest in this chamber, and this chamber is important in reducing the pressure and associated noise. The "L" shaped chamber nests within the adjoining S shaped chamber to provide a larger volume for gas expansion. The foot of the "L" extends below the top of the inverted "S" of the adjoining chamber. The chambers as shown have relatively vertical walls at each end thereof. It is preferred that the baffle core comprise at least three (3) curved or "S" shaped chambers, each of which is smaller in volume than the blast chamber. Multiple "L" shaped chambers may be used. The number and size of the chambers may be selected by the caliber and type of firearm to which the device is mounted.

An external structural frame is positioned on the exterior of the body and opposite the baffle core. This exo-skeletal frame strengthens the sound suppressor in the area of the suppressor that is under the highest stress, which is the blast chamber of the baffle core. By placing the external structural frame outside the body, this primary structural element of the suppressor is not present within the baffle core or the body. The external structural frame does not interfere with the blast chamber, and does not occupy space within the baffle core or the blast chamber that would reduce the efficacy of the suppressor. At the same time, the external structural frame provides strength to the suppressor where strength and structural integrity are needed most.

In a preferred embodiment, the external structural frame extends from an end of the suppressor that is proximal to the firearm and over the outside of the body to just beyond the blast chamber of the baffle core. It is preferred that the blast chamber also extends from near an end of the baffle core that is proximal to the firearm, and that it extends along 25 to 40% of the overall length of the baffle core. Accordingly, the external structural frame also extends about 25% and up to about 40% of the length of the suppressor. The external structural frame is preferred to completely surround the portion of the body in which the blast chamber is housed as shown in the drawings, and the body completely surrounds and completely houses the baffle core. The external structural frame is present over, and on the exterior of, the entire portion of the body that houses the blast chamber in the preferred embodiment. The external structural frame may be secured by crimping/rolling the external structural frame into a small groove at a proximal end of the baffle core.

It is preferred that the external structural frame is a unitary member. Similarly, it is preferred that the baffle core is a unitary member and that the body is a unitary member.

Figure 2:
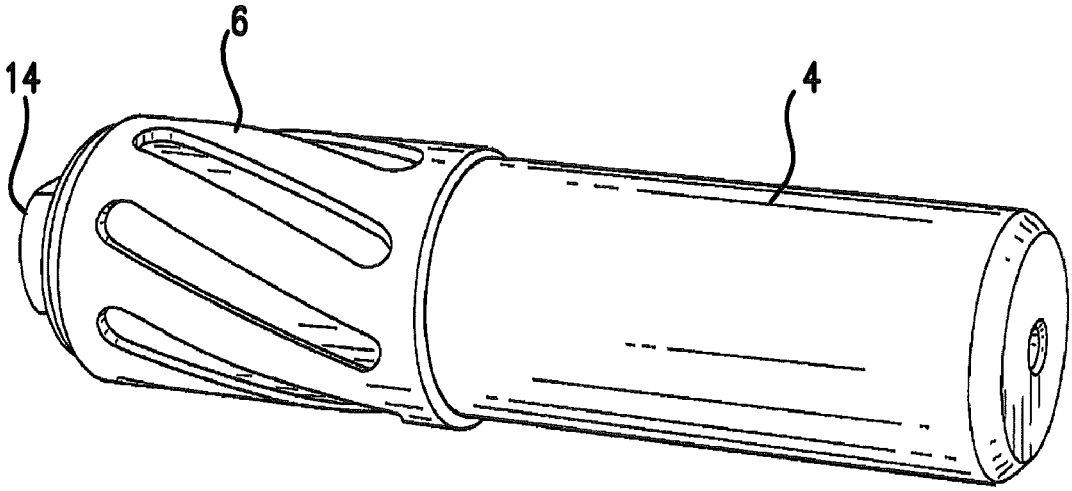
FIG. 2 is a perspective view of an embodiment of the suppressor.
Figure 3:
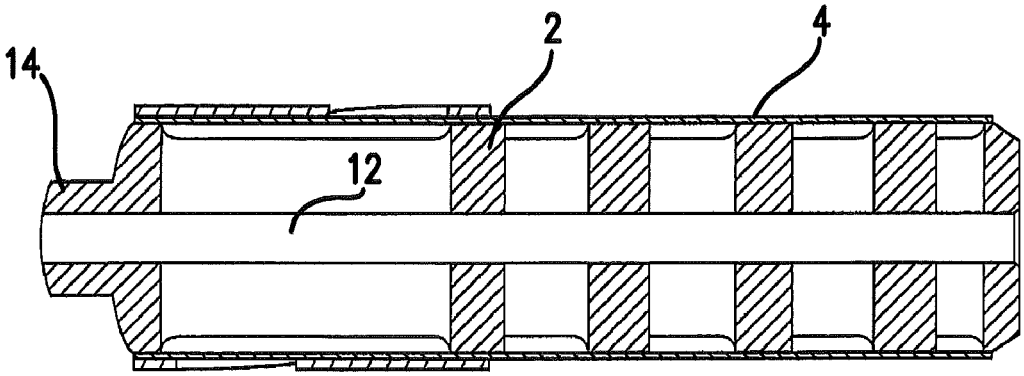
FIG. 3 is a sectioned view of the suppressor according to an embodiment of the invention.
Figure 4:
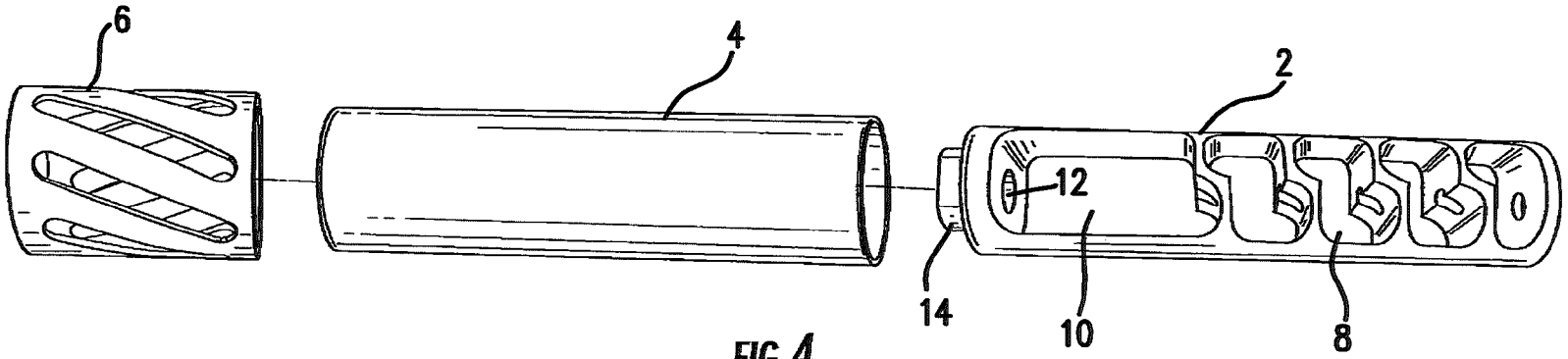
FIG. 4 is an exploded view of the suppressor according to an embodiment of the invention.

The external structural frame is preferred to have voids or holes formed therein. As shown in FIG. 1, the holes may be round, or as shown in FIG. 2, the holes may be fluted, or helical. The holes or voids could be other shapes. The holes or voids aid cooling of the suppressor, reduce weight of the suppressor, and also provide a grip for threading the suppressor onto the firearm, helping to secure the suppressor to the firearm.

It is preferred that the baffle core is sealed relative to the body, so that sound and gas produced by the discharged firearm are effectively captured and regulated. In one embodiment the invention is constructed by rolling or crimping the body into small grooves formed near each end of the baffle core. This construction forces the hot gases to escape only through the exit bore. The "ends" are the portion of the baffle core beyond the "L" shaped chambers. The resulting structure also contributes to the structural integrity of the device by equally distributing the pressure created by the propellant gases.

The preferred unitary construction of the baffle core, such as by the use of a single billet to construct the core, yields substantial structurally integrity. The preferred chamber shapes and chamber placement are highly effective in the suppression of sound, by causing turbulence which disrupts and slows the escape of hot gases from the discharged firearm. Sealing the baffle core to the body yields superior suppression of sound and a high level of structural integrity in securing the body to the baffle core. Sealing, such as by rolling/crimping the body into the baffle core grooves, forces the hot gasses into the chambers and allows no exit of the gasses, except through the bore, which levels the pressures inside the suppressor.

What is claimed is:

1. A sound suppressor for firearms, comprising:

a baffle core, the baffle core comprising a plurality of chambers, and comprising a blast chamber that is larger than a chamber of the plurality of chambers, wherein the blast chamber is constructed and arranged to be proximal to a mounting point of the sound suppressor to a firearm;

a body in which the baffle core is contained internally in the body; an external structural frame that is positioned externally over a portion of the body, wherein the external structural frame is positioned wherein the external structural frame is positioned entirely externally to the blast chamber and proximally to the mounting point of the sound suppressor to the firearm and opposite the body from the baffle core.

2. A sound suppressor for firearms as described in claim 1, wherein the external structural frame surrounds an entire perimeter of a portion of the body.

3. A sound suppressor for firearms as described in claim 1, wherein the external structural frame extends not more than 40% of the length of the body.

4. A sound suppressor for firearms as described in claim 1, wherein the external structural frame extends over the entire length of the blast chamber.

5. A sound suppressor for firearms as described in claim 1, wherein the external structural frame comprises holes formed therein.

6. A sound suppressor for firearms as described in claim 1, wherein the external structural frame comprises helical fluting holes formed therein.

7. A sound suppressor for firearms as described in claim 1, wherein the blast chamber comprises an "L" shaped space, with the foot of the "L" distal to the mounting point of the sound suppressor to the firearm.

8. A sound suppressor for firearms as described in claim 1, wherein the blast chamber comprises a generally "L" shaped space, with the foot of the "L" distal to the mounting point of the sound suppressor to the firearm, and wherein the plurality of chambers are generally "S" shaped, and wherein a center step in the "S" shape of each of the plurality of chambers comprises a central void.

9. A sound suppressor for firearms as described in claim 1, wherein the external structural frame is a unitary member.

10. A sound suppressor for firearms as described in claim 1, wherein the external structural frame surrounds is a unitary member and the external structural frame surrounds an entire perimeter of a portion of the body.

11. A sound suppressor for firearms as described in claim 1, wherein the external structural frame is a unitary member and the body is a unitary member.

12. A sound suppressor for firearms as described in claim 1, wherein the external structural frame is a unitary member, the baffle core is a unitary member and the body is a unitary member.

* * * * *